US010393002B2

(12) United States Patent
Sugi

(10) Patent No.: US 10,393,002 B2
(45) Date of Patent: Aug. 27, 2019

(54) EXHAUST DEVICE OF STRADDLE-TYPE VEHICLE

(71) Applicant: SUZUKI MOTOR CORPORATION, Hamamatsu-shi, Shizuoka (JP)

(72) Inventor: Yoshinori Sugi, Hamamatsu (JP)

(73) Assignee: SUZUKI MOTOR CORPORATION, Hamamatsu-shi (JP)

( * ) Notice: Subject to any disclaimer, the term of this patent is extended or adjusted under 35 U.S.C. 154(b) by 0 days.

(21) Appl. No.: 16/016,170

(22) Filed: Jun. 22, 2018

(65) Prior Publication Data

US 2019/0017428 A1 Jan. 17, 2019

(30) Foreign Application Priority Data

Jul. 11, 2017 (JP) ..... 2017-135261

(51) Int. Cl.
*F01N 13/04* (2010.01)
*F01N 1/08* (2006.01)

(52) U.S. Cl.
CPC ..... *F01N 13/04* (2013.01); *F01N 1/083* (2013.01); *F01N 1/084* (2013.01);
(Continued)

(58) Field of Classification Search
CPC ..... B60K 15/03177; B60K 15/03504; B60K 2015/03467; B60K 2015/03514; B60K 2015/0777; B60K 15/04; B60K 2015/03453; B60K 2015/0477; F02M 25/0854; F02M 25/089; F02M 37/106; F01N 5/025; F01N 13/04; F01N 1/084; F01N 2260/14; F01N 2590/04; F02D 9/04; F02D 9/106; F16K 1/224; H01L 35/30; Y02T 10/16
(Continued)

(56) References Cited

U.S. PATENT DOCUMENTS 6,381,956 B1 * 5/2002 Gilbertson ..... F01N 13/08 181/228
6,742,332 B2 * 6/2004 Piekarski ..... F01N 13/08 60/313
(Continued)

FOREIGN PATENT DOCUMENTS

EP 3276149 A1 * 1/2018 ..... B62M 7/02
JP 4767183 B2 6/2011
WO WO-2009084455 A1 * 7/2009 ..... B62H 1/04

*Primary Examiner* — Paul N Dickson
*Assistant Examiner* — Hilary L Johns
(74) *Attorney, Agent, or Firm* — Stein IP, LLC

(57) ABSTRACT

There is provided an exhaust device of a straddle-type vehicle. A first muffler body is arranged at one side, at which a drive chain is not arranged, in a region at the rear of a chamber. A second muffler body is arranged at another side, at which the drive chain is arranged. A first connection pipe interconnects the chamber and the first muffler body. A second connection pipe interconnects the chamber and the second muffler body. An exhaust control valve is configured to control a flow rate of exhaust air to circulate from an exhaust port toward the first muffler body via an exhaust pipe, the chamber and the first connection pipe. A part or all of the second connection pipe is formed to have a pipe shape by two or more plate materials, and has a non-true circular cross-sectional surface shape.

8 Claims, 9 Drawing Sheets

(52) U.S. Cl.
CPC ..... *F01N 2260/14* (2013.01); *F01N 2560/07* (2013.01); *F01N 2590/04* (2013.01)

(58) Field of Classification Search
USPC ..... 603/324; 1/1; 180/309
See application file for complete search history.

(56) References Cited

U.S. PATENT DOCUMENTS

| | | | | |
|---|---|---|---|---|
| 7,364,010 | B2 * | 4/2008 | Konno | B62K 19/30 180/219 |
| 8,359,847 | B2 * | 1/2013 | Hatchett | B21D 39/044 60/274 |
| 8,474,252 | B2 * | 7/2013 | Butler | F01N 13/08 60/305 |
| 8,701,823 | B2 * | 4/2014 | Matsushima | F01N 1/006 180/219 |
| 2008/0168767 | A1 * | 7/2008 | Kanzawa | F01N 13/04 60/324 |
| 2013/0125535 | A1 * | 5/2013 | Schultz | F01N 3/00 60/314 |

* cited by examiner

EXHAUST DEVICE OF STRADDLE-TYPE VEHICLE

CROSS-REFERENCE TO RELATED APPLICATIONS

The disclosure of Japanese Patent Application No. 2017-135261 filed on Jul. 11, 2017, including specification, drawings and claims is incorporated herein by reference in its entirety.

TECHNICAL FIELD

The present disclosure relates to an exhaust device of a straddle-type vehicle.

BACKGROUND

A straddle-type vehicle such as a motorcycle having two mufflers provided at left and right sides of a vehicle rear part has been known. In the straddle-type vehicle, for example, the exhaust air having flowed out from each exhaust port of an engine having a plurality of cylinders is collected by a collecting pipe, is distributed to the two mufflers and is discharged to the atmosphere from each muffler.

Also, regarding the straddle-type vehicle having the two mufflers, a straddle-type vehicle has been known which includes an exhaust control valve provided on the way of an exhaust passage between the collecting pipe and one muffler and configured to control a flow rate of the exhaust air to circulate in the exhaust passage.

For example, an exhaust device disclosed in Patent Document 1 includes four individual exhaust pipes connected to respective exhaust ports of a four-cylinder engine, a collecting pipe configured to collect the individual exhaust pipes into one, two exhaust mufflers arranged at left and right sides, and an exhaust air device configured to control flow of an exhaust gas. The collecting pipe is branched at an exhaust air downstream side into left and right branch exhaust pipes, and the left branch exhaust pipe is directly connected with the left exhaust muffler, and the right branch exhaust pipe is connected with the right exhaust muffler via the exhaust air device. The exhaust air device includes a valve configured to control flow of the exhaust gas in an exhaust passage configured to interconnect the right branch exhaust pipe and the right exhaust muffler.

Patent Document 1: Japanese Patent No. 4767183 B

As described above, the exhaust control valve is provided on the way of the exhaust passage communicating with the muffler and a degree of opening of the exhaust control valve is changed in accordance with a magnitude of an engine load, and the like, so that it is possible to improve output and torque characteristics of the engine or to improve an exhaust sound quality. Specifically, in a high load state, the degree of opening of the exhaust control valve is increased to cause the exhaust air to smoothly circulate, thereby increasing the engine output or creating a fascinating exhaust sound, which expresses that the engine is favorably racing. On the other hand, in a low load state, the degree of opening of the exhaust control valve is decreased to increase a back pressure and to suppress lowering of torque during low revolution.

In the straddle-type vehicle having the two mufflers, it is ideal to provide each exhaust control valve at inlet sides of both the muffler. However, if the two exhaust control valves are provided, the number of actuators for operating the exhaust control valves increases, which causes an increase in cost. Further, the number of cables for sending a control signal to the actuators, and the like increases, which makes a layout of components complicated. Considering the demerits, it is proper to provide the exhaust control valve at the inlet side of one muffler.

In a configuration where the exhaust control valve is provided at the inlet side of one muffler, in the low load state, in order to secure the torque during the low revolution, it is necessary to decrease the degree of opening of the exhaust control valve for causing most of the exhaust air to circulate in the other muffler and to thereby increase the back pressure. In order to satisfy the requirements, it is considered to form a bent part at a piping configured to interconnect a point at which the collected exhaust passage is branched toward the two mufflers and the inlet of the other muffler, and to lengthen the piping, thereby presenting a resistance to the exhaust air flowing in the piping. However, it is not easy to implement this configuration.

That is, recently, in order to improve the engine output or to reduce the exhaust sound, a chamber may be interposed between the exhaust pipe connected to the exhaust port (or the collecting pipe connected to the exhaust pipes) and each muffler body. When the chamber is interposed, the point at which the collected exhaust passage is branched toward the two mufflers becomes an outlet of the chamber. The outlet of the chamber and an inlet of the muffler body are close to each other. For this reason, in order to lengthen a piping configured to interconnect the outlet of the chamber and the inlet of the muffler body, it is necessary to increase the number of bent parts to be provided to the piping or to increase a curvature of the bent part. However, in the related art, since the piping is a pipe made of metal, it is not easy to form many bent parts at the piping. Also, if the curvature of the bent part is increased, a weak part is formed at the bent part, so that strength of the piping may be lowered.

Also, a plurality of components such as a footrest and the like is arranged around the outlet of the chamber. The piping configured to interconnect the outlet of the chamber and the inlet of the muffler body should be formed with the multiple bent parts or it is necessary to increase the curvature of the bent part so that the piping is to be arranged not to contact the corresponding components. However, it is difficult to implement such configurations, as described above.

SUMMARY

It is therefore one of objects of the present disclosure to provide an exhaust device of a straddle-type vehicle having a configuration where an exhaust control valve is provided to an inlet-side of one muffler body of two muffler bodies connected to a downstream side of a chamber and a degree of freedom of a shape setting of a piping configured to interconnect the chamber and the other muffler body is increased to easily implement setting of a back pressure in a low load state of an engine or avoidance of contact of the piping with other components.

According to an aspect of the embodiments of the present disclosure, there is provided an exhaust device of a straddle-type vehicle, comprising: a chamber arranged at the rear of an engine of the straddle-type vehicle; an exhaust pipe configured to interconnect an exhaust port of the engine and the chamber; a first muffler body arranged at one side, at which a drive chain is not arranged, of a left side and a right side of the straddle-type vehicle, in a region at the rear of the chamber; a second muffler body arranged at another side, at which the drive chain is arranged, of the left side and the right side of the straddle-type vehicle, in the region at the rear of the chamber; a first connection pipe configured to interconnect the chamber and the first muffler body; a second connection pipe configured to interconnect the chamber and the second muffler body; and an exhaust control valve configured to control a flow rate of exhaust air to circulate from the exhaust port toward the first muffler body via the exhaust pipe, the chamber and the first connection pipe, wherein a part or all of the second connection pipe is formed to have a pipe shape by two or more plate materials bonded to each other, and has a non-true circular cross-sectional surface shape.

According to the present disclosure, in the exhaust device having a configuration where the exhaust control valve is provided to the inlet-side of one muffler body of the two muffler bodies connected to the downstream side of the chamber, it is possible to increase the degree of freedom of the shape setting of the piping configured to interconnect the chamber and the other muffler body. Thereby, it is possible to easily implement the setting of the back pressure in the low load state of the engine or avoidance of contact of the piping with other components.

DETAILED DESCRIPTION OF THE EMBODIMENTS

Figure 1:
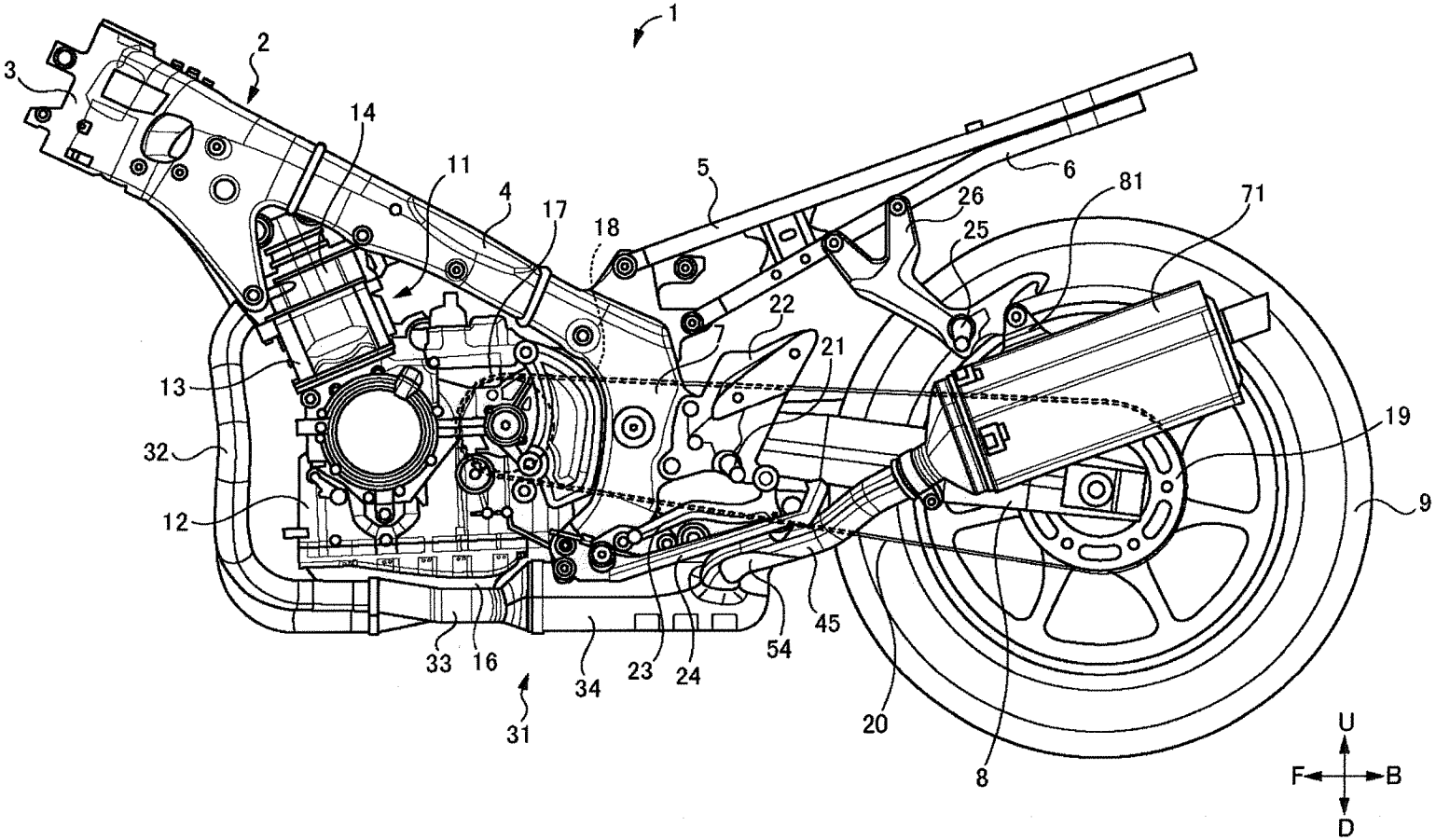
FIG. 1 depicts an outward appearance of a straddle-type vehicle having an exhaust device of an illustrative embodiment of the present disclosure, as seen from the left.

An exhaust device of an illustrative embodiment of the present disclosure includes a chamber arranged at the rear of an engine of a straddle-type vehicle, an exhaust pipe configured to interconnect an exhaust port of the engine and the chamber, a first muffler body, a second muffler body, a first connection pipe configured to interconnect the chamber and the first muffler body, a second connection pipe configured to interconnect the chamber and the second muffler body, and an exhaust control valve.

The first muffler body is arranged at one side, at which a drive chain is not arranged, of a left side and a right side of the straddle-type vehicle, in a region at the rear of the chamber. On the other hand, the second muffler body is arranged at another side, at which the drive change is arranged, of the left side and the right side of the straddle-type vehicle, in the region at the rear of the chamber.

The exhaust control valve is configured to control a flow rate of exhaust air to circulate from the exhaust port to the first muffler body via the exhaust pipe, the chamber and the first connection pipe. The exhaust control valve is provided to the first connection pipe, for example.

The first connection pipe is configured by a metallic pipe, for example. In the meantime, a part or all of the second connection pipe is formed to have a pipe shape by two or more plate materials bonded to each other, and has a non-true circular cross-sectional surface shape.

A general straddle-type vehicle has a swing arm having a pair of left and right arm parts, and a rear wheel is supported between the arm parts. In the straddle-type vehicle, a drive chain is arranged to pass an inner side of one arm part of the swing arm, as seen from above. For this reason, the arm part, which is provided at the side at which the drive chain is arranged, of the swing arm more protrudes outward in a right and left direction of the vehicle, as compared to the arm part provided at the opposite side. That is, the arm part, which is provided at the side at which the drive chain is not arranged, less protrudes outward in the right and left direction, as compared to the arm part provided at the side at which the drive chain is arranged. Therefore, at the side, at which the drive chain is not arranged, of the rear part of the straddle-type vehicle, it is possible to more easily make the connection pipe configured to interconnect the chamber and the muffler body close to a straight line, as compared to the side at which the drive chain is arranged.

Therefore, in the exhaust device of the illustrative embodiment of the present disclosure, the first connection pipe having the exhaust control valve provided thereto and the first muffler body are arranged at the side, at which the drive chain is not arranged, of the rear part of the straddle-type vehicle. Thereby, it is possible to make the first connection pipe close to a straight line, so that it is possible to open the exhaust control valve and to smoothly circulate the exhaust air in a high load state of the engine. Accordingly, it is possible to increase an engine output or to improve an exhaust sound quality.

Meanwhile, in the exhaust device of the illustrative embodiment of the present disclosure, the second connection pipe and the second muffler body are arranged at the side, at which the drive change is arranged, of the rear part of the straddle-type vehicle. Therefore, it is difficult to make the second connection pipe close to a straight line, as compared to the first connection pipe. Also, for the second connection pipe, it is required to present a resistance to the exhaust air circulating in the second connection pipe and to thereby increase a back pressure so as to improve engine torque when decreasing a degree of opening of the exhaust control valve provided to the first connection pipe, in the low load state of the engine. For this reason, preferably, the second connection pipe has more bent parts and a longer pipe length than the first connection pipe.

Regarding this, in the exhaust device of the illustrative embodiment of the present disclosure, the second connection pipe is partially or entirely formed to have a pipe shape by two or more plate materials bonded to each other. Each plate material is a metal plate, for example, and can be easily shaped by press working. Therefore, when the second connection pipe is formed by bonding the plate materials, it is possible to increase a degree of freedom of a shape setting of the second connection pipe. Specifically, it is possible to easily form the second connection pipe with a plurality of bent parts, and to increase a curvature of the bent part while keeping strength of the second connection pipe. For this reason, even when an outlet of the chamber and an inlet of the second muffler body are close to each other, it is possible to easily lengthen the second connection pipe by increasing the number of the bent parts of the second connection pipe or increasing the curvature of the bent part.

Also, since the second connection pipe has the high degree of freedom of the shape setting, it is possible to easily and precisely determine positions of the plurality of bent parts to be formed at the second connection pipe. Therefore, it is possible to easily set a layout of the second connection pipe so as to avoid contact between a plurality of components arranged around the outlet of the chamber and the second connection pipe.

Also, the second connection pipe has a non-true circular cross-sectional surface shape. The non-true circular shape is a shape that is not a true circle, and a shape in which a part of a circumference of a true circle is concave, a shape in which a part of a true circle is cut at a line intersecting with the true circle, a semicircular shape, an elliptical shape, a triangular shape, a quadrangular shape, a pentagonal shape, a hexagonal shape, a polygonal shape, a wedge shape, and the like may be exemplified. The cross-sectional surface of the second connection pipe is made to have the non-true circular shape, so that it is possible to secure intervals between the second connection pipe and the components around there. Accordingly, it is possible to easily avoid the contact of the second connection pipe with the other components. Also, the cross-sectional surface of the second connection pipe is made to have the non-true circular shape, so that it is possible to prevent the second connection pipe from contacting a ground upon turning of the straddle-type vehicle. For example, a curved circumferential surface of the second connection pipe, which protrudes outward laterally, is crushed to form a flat surface, so that it is possible to increase an interval between the second connection pipe and the ground upon the turning of the straddle-type vehicle and to prevent the second connection pipe and the ground from contacting each other.

Illustrative Embodiment (Straddle-Type Vehicle)

Figure 2:
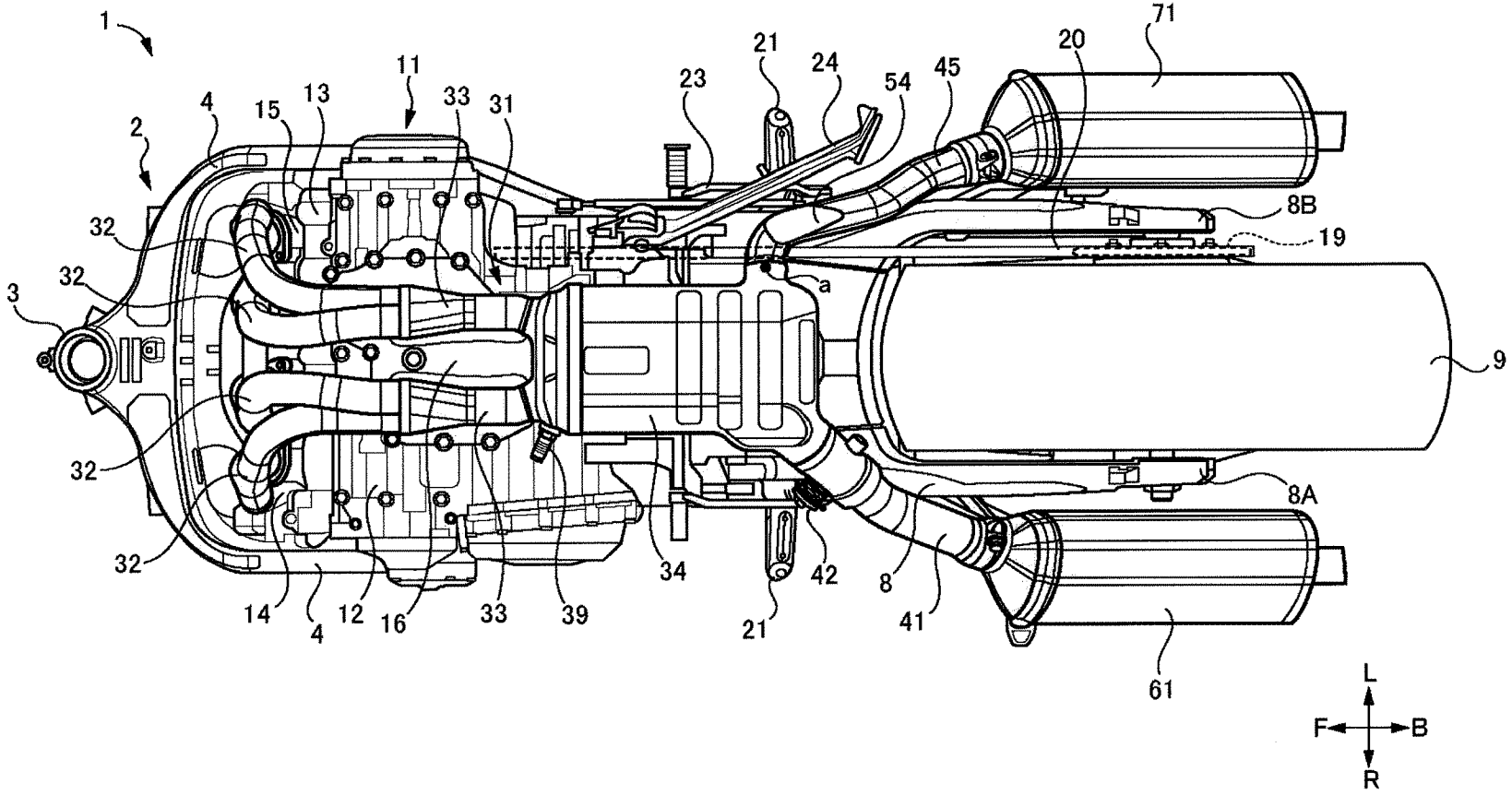
FIG. 2 depicts the outward appearance of the straddle-type vehicle having the exhaust device of the illustrative embodiment of the present disclosure, as seen from below.

FIG. 1 depicts a straddle-type vehicle 1 having an exhaust device 31 of the illustrative embodiment of the present disclosure 31, as seen from the left, and FIG. 2 depicts the straddle-type vehicle 1, as seen from below. Meanwhile, in below descriptions of the illustrative embodiment, shapes, arrangement and the like of components are described on the basis of a driver of the straddle-type vehicle 1. The arrows shown in the right lower parts of FIGS. 1, 2, 3, 4, 6, 7 and 8 indicates front (F), back (B), left (L), right (R), up (U) and down (D) directions on the basis of the driver of the straddle-type vehicle 1.

In FIG. 1, the straddle-type vehicle 1 is a motorcycle, for example. A vehicle body frame 2 forming a frame of the straddle-type vehicle 1 includes a head pipe 3, a pair of left and right main frames 4, a pair of left and right upper seat rails 5, and a pair of left and right lower seat rails 6. A front end portion of each main frame 4 is connected to the head pipe 3, and a rear end of each main frame 4 extends rearward, is curved and extends downward. A front end portion of each upper seat rail 5 and a front end portion of each lower seat rail 6 are connected to a rear upper side of each main frame 4, and each upper seat rail 5 and each lower seat rail 6 extend rearward from the rear upper side of each main frame 4. Also, pivot support parts 7 are respectively formed at parts extending downward from rear parts of the pair of main frames 4, and a front end portion of a swing arm 8 is supported to be swingable vertically between the pivot support parts 7. Also, a rear wheel 9 is rotatably supported to a rear end portion of the swing arm 8. In the meantime, although not shown, a steering shaft is rotatably supported to the head pipe 3, a handle and front forks are supported to the steering shaft via brackets, and a front wheel is rotatably supported to the front forks.

Also, an engine 11 is supported to each main frame 4. The engine 11 includes a crankcase 12, a cylinder 13 provided above the crankcase 12, a cylinder head 14 provided above the cylinder 13, an oil fan 15 provided below the crankcase 12, and a transmission case 17 integrally formed at a rear part of the crankcase 12.

Also, a left part of the transmission case 17 is provided with a drive sprocket 18, a driven sprocket 19 is fixed to a left part of a wheel boss part of the rear wheel 9, and a drive chain 20 is spanned between the drive sprocket 18 and the driven sprocket 19. As shown in FIG. 2, the drive chain 20 extends in a front and back direction in a rear left region of the straddle-type vehicle 1. Specifically, as seen from above, the drive chain 20 is arranged to pass an inner side of a left arm part 8B of the swing arm 8. In the meantime, the left arm part 8B of the swing arm 8 protrudes outward laterally, i.e., leftward from the straddle-type vehicle 1, as compared to a right arm part 8A, so as to enable the drive chain 20 to pass the inner side of the left arm part 8B of the swing arm 8.

Also, at right and left sides of the straddle-type vehicle 1, footrests 21 on which driver's feet are to be put are provided at the rear of the engine 11. The footrest 21 is mounted to a rear part of the pivot support part 7 of the main frame 4 via a stay 22. As shown in FIG. 2, the right footrest 21 protrudes rightward, and the left footrest 21 protrudes leftward. Also, at the left side of the straddle-type vehicle 1, a shift lever 23 for switching a gear of a transmission on the basis of a left foot operation of the driver is provided below the footrest 21. A rear end portion (base end portion) of the shift lever 23 is rotatably mounted to the stay 22. Also, at the left side of the straddle-type vehicle 1, a prop stand 24 for supporting the straddle-type vehicle 1 so as not to fall during stop of the straddle-type vehicle 1 is provided below the shift lever 23. A front end portion (base end portion) of the prop stand 24 is rotatably mounted to a lower end portion of the pivot support part 7 of the left main frame 4. Also, pillion footrests 25 are respectively mounted to the right and left lower seat rails 6 via stays 26.

(Exhaust Device)

Figure 3:
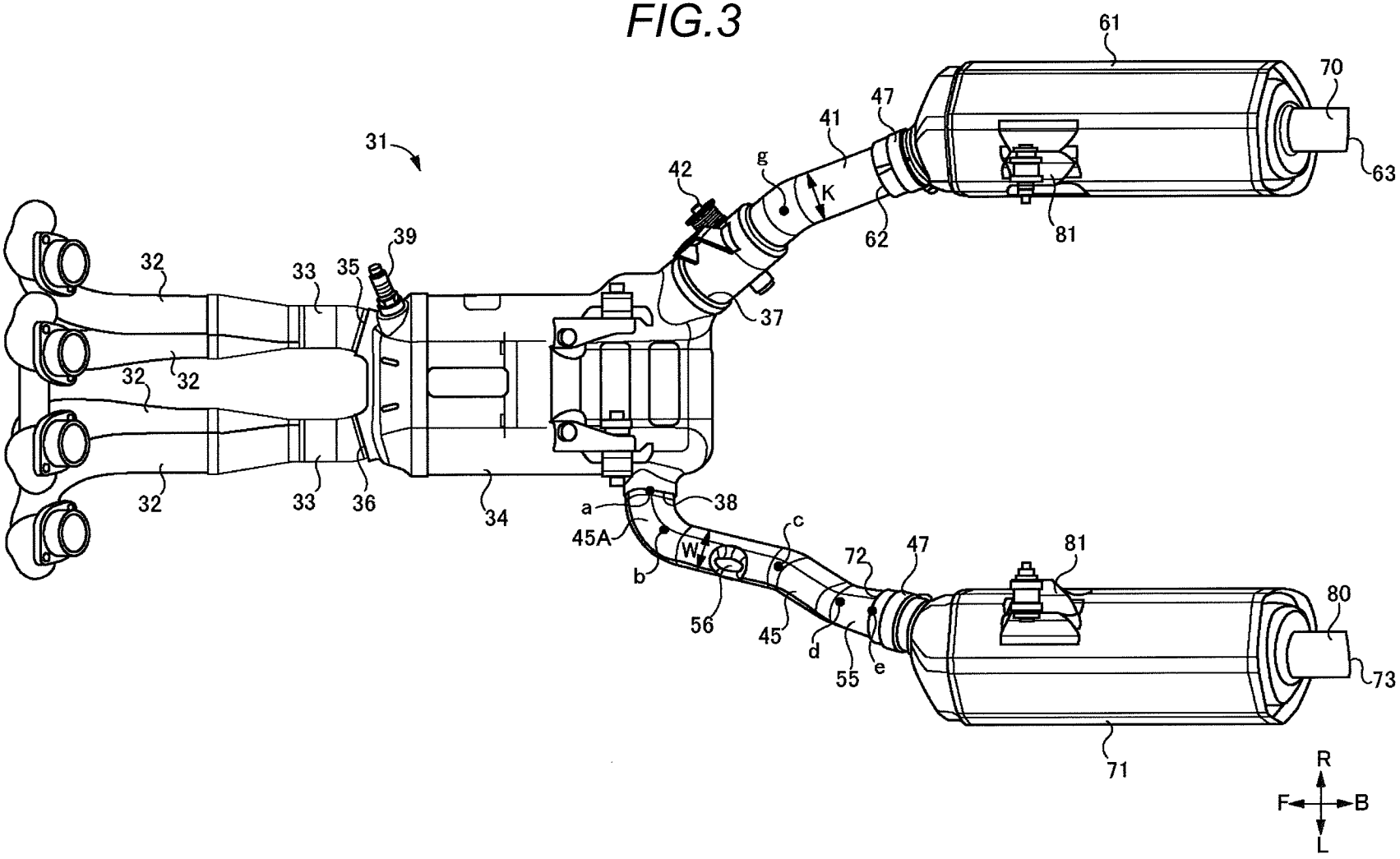
FIG. 3 depicts an outward appearance of the exhaust device of the illustrative embodiment of the present disclosure, as seen from above.
Figure 4:
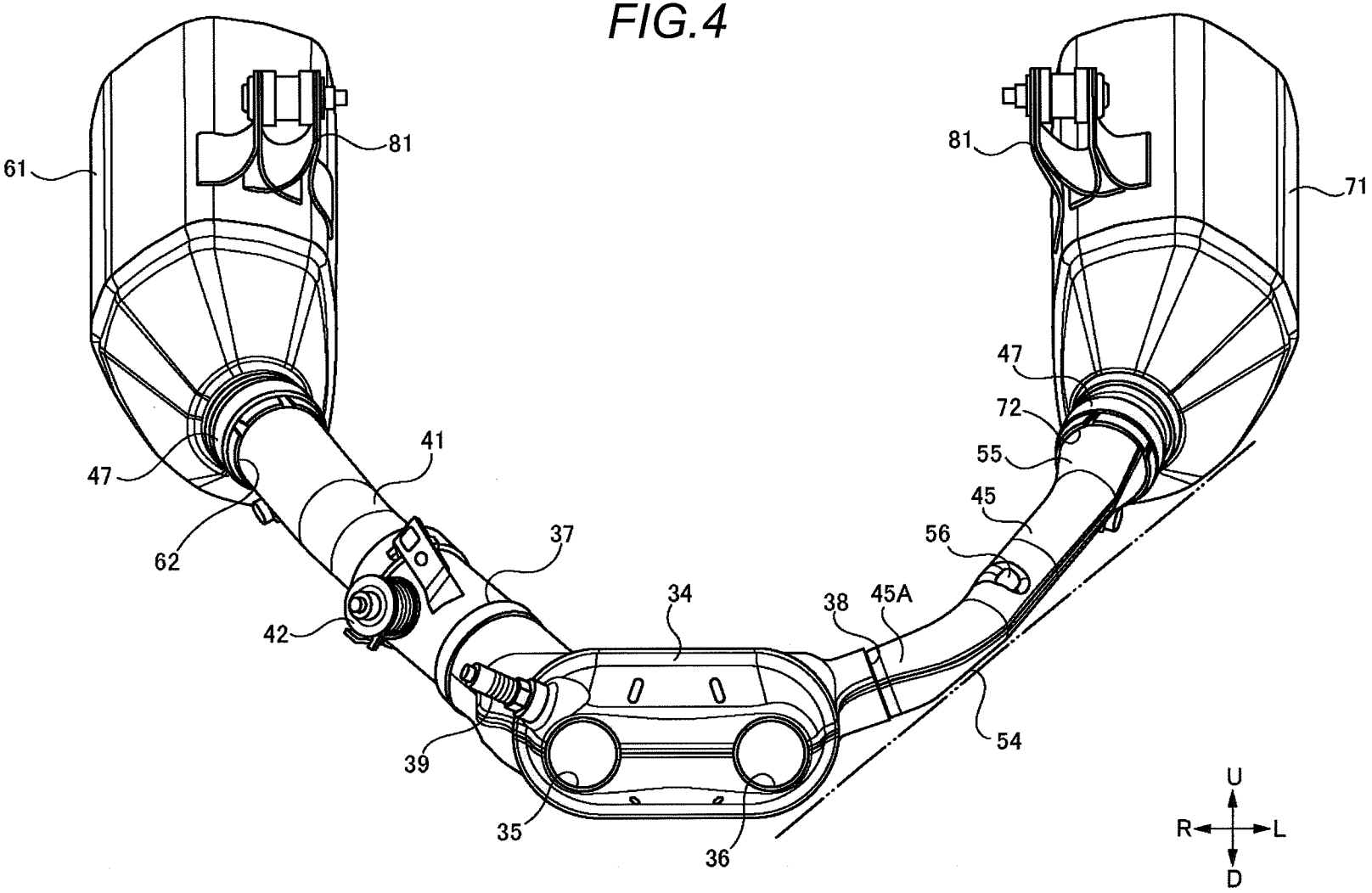
FIG. 4 depicts an outward appearance of a chamber, a pair of connection pipes and a pair of muffler bodies of the exhaust device of the illustrative embodiment of the present disclosure, as seen from the front.

FIG. 3 depicts the exhaust device 31 of the illustrative embodiment of the present disclosure 31, as seen from above. FIG. 4 depicts a chamber 34, a right connection pipe 41, a left connection pipe 45, a right muffler body 61 and a left muffler body 71 of the exhaust device 31, as seen from the front.

In FIG. 3, the exhaust device 31 is a device configured to discharge the exhaust air having flowed out from each exhaust port 15 of the engine 11 to the atmosphere. The exhaust device 31 includes four exhaust pipe 32, two collecting pipes 33, a chamber 34, two connection pipes (a right connection pipe 41 and a left connection pipe 45), two muffler bodies (a right muffler body 61 and a left muffler body 71) and an exhaust control valve 42.

(Exhaust Pipe/Collecting Pipe)

Each exhaust pipe 32 and each collecting pipe 33 are pipings configured to interconnect each exhaust port 15 of the engine 11 and the chamber 34. Each exhaust pipe 32 is a metallic pipe. Each collecting pipe 33 is configured by combining metallic pipes. The straddle-type vehicle 1 of the illustrative embodiment has the four-cylinder engine 11 mounted thereto, and a front part of the cylinder head 14 of the engine 11 is provided with four exhaust ports 15. Front end portions of the four exhaust pipes 32 are respectively connected to the four exhaust ports 15. Also, rear end portions of the two exhaust pipes 32, which are arranged at the right side, of the four exhaust pipes 32 are connected to a front end portion of one collecting pipe 33 arranged at the right side, and a rear end portion of the collecting pipe 33 is connected to a right inlet 35 of the chamber 34. On the other hand, rear end portions of the two exhaust pipes 32, which are arranged at the left side, of the four exhaust pipes 32 are connected to a front end portion of one collecting pipe 33 arranged at the left side, and a rear end portion of the collecting pipe 33 is connected to a left inlet 36 of the chamber 34.

(Chamber)

The chamber 34 has a box shape having therein a space. For example, the chamber 34 is formed by bonding two metal plates made as a result of press working each other in the vertical direction. A right side of a front part of the chamber 34 is formed with the right inlet 35, and a left side of the front part of the chamber 34 is formed with the left inlet 36. The right inlet 35 and the left inlet 36 are all arranged on a front surface of the chamber 34. The chamber 34 is formed at a rear right side with a right outlet 37, and is formed at a rear left side with a left outlet 38. The right outlet 37 is arranged on a rear surface of the chamber 34. As shown in FIG. 4, a circumferential edge part of the right outlet 37 of the chamber 34 protrudes rearward with being inclined in a right upper direction. In the meantime, the left outlet 38 is formed on a left surface of the chamber 34. A circumferential edge part of the left outlet 38 of the chamber 34 protrudes leftward with being inclined upward.

The exhaust airs guided by the four exhaust pipes 32 and the two collecting pipes 33 are introduced into the chamber 34 from the right inlet 35 and the left inlet 36, and join in the chamber 34. Thereafter, the exhaust air in the chamber 34 flows out from the right outlet 37 and the left outlet 38, respectively. The chamber 34 has a function of reducing an exhaust sound. A volume of the chamber 34 is set so that the high effect of reducing the exhaust sound is to be obtained. Also, a front part in the chamber 34 is provided with a catalyst device for purifying the exhaust air. Also, a right side of the front part of the chamber 34 is mounted with an exhaust gas sensor 39 for detecting an oxygen concentration of the exhaust air.

As shown in FIG. 1, the chamber 34 is arranged at the rear of the engine 11 and below the pivot support part 7 of each main frame 4, as seen from a side. Referring to FIGS. 1 and 2, a front end portion of the chamber 34 is positioned at the rear of the oil fan 16 provided below the engine 11, and a rear end portion of the chamber 34 is positioned at the rear of each footrest 21. Also, as shown in FIG. 2, the chamber 34 is arranged at a substantial center of the straddle-type vehicle 1 in the right and left direction. Also, the chamber 34 is mounted to a bridge part spanning between the pivot support parts 7 of the right and left main frames 4 via a bracket.

(Right Connection Pipe)

The right connection pipe 41 is a piping configured to interconnect the chamber 34 and the right muffler body 61. The right connection pipe 41 is arranged at one side, at which the drive chain 20 is not arranged, of the left side and right side of the straddle-type vehicle 1, i.e., at the right side of the straddle-type vehicle 1. A front end portion of the right connection pipe 41 is connected to the right outlet 37 of the chamber 34 by welding, for example. A rear end portion of the right connection pipe 41 is connected to a muffler inlet 62 of the right muffler body 61. Specifically, a circumferential edge part of the muffler inlet 62 of the right muffler body 61 protrudes forward, and the rear end portion of the right connection pipe 41 is inserted in the circumferential edge part of the muffler inlet 62, and is fastened and fixed by a ring-shaped fastener 47 provided at an outer periphery-side of the circumferential edge part.

The right connection pipe 41 is a metallic pipe having a true circular cross-sectional surface shape. The right connection pipe 41 extends rearward with being inclined in a right upper direction from the right outlet 37 of the chamber 34 toward the muffler inlet 62 of the right muffler body 61. Also, the right connection pipe 41 is small and gently curved at a position g in FIG. 3 but the other part thereof extends in a substantially linear shape.

(Exhaust Control Valve)

Also, the right connection pipe 41 is provided with the exhaust control valve 42. The exhaust control valve 42 is a valve configured to control a flow rate of the exhaust air to circulate from each exhaust port 15 to the right muffler body 61 via each exhaust pipe 32, each collecting pipe 33, the chamber 34 and the right connection pipe 41. It is possible to suppress the flow rate of the exhaust air toward the right muffler body 61 by reducing a degree of opening of the exhaust control valve 42. In the illustrative embodiment, the exhaust control valve 42 is a valve configured to open and close an exhaust passage in the right connection pipe 41, and is a butterfly valve, for example. The exhaust control valve 42 is arranged at a part of the right connection pipe 41, which is closer to the right outlet 37 of the chamber 34 than an intermediate part of the right connection pipe 41 in the front and back direction. In the vicinity of the exhaust control valve 42, a motor configured to open and close the valve of the exhaust control valve 42 is provided. The motor is controlled by a control signal that is to be output from a control device such as an ECU (engine control unit) or the like. The ECU has a function of changing the degree of opening of the exhaust control valve 42 in accordance with a load and the like of the engine 11, for example.

(Left Connection Pipe)

The left connection pipe 45 is a piping configured to interconnect the chamber 34 and the left muffler body 71. The left connection pipe 45 is arranged at another side, at which the drive chain 20 is arranged, of the left side and right side of the straddle-type vehicle 1, i.e., at the left side of the straddle-type vehicle 1. A front end portion 45A of the left connection pipe 45 is connected to the left outlet 38 of the chamber 34 by welding, for example. A rear end portion 45B (refer to FIG. 5) of the left connection pipe 45 is connected to a muffler inlet 72 of the left muffler body 71. Specifically, a circumferential edge part of the muffler inlet 72 of the left muffler body 71 protrudes forward, and the rear end portion 45B of the left connection pipe 45 is inserted in the circumferential edge part of the muffler inlet 72, and is fastened and fixed by a ring-shaped fastener 47 provided at an outer periphery-side of the circumferential edge part.

Figure 5:
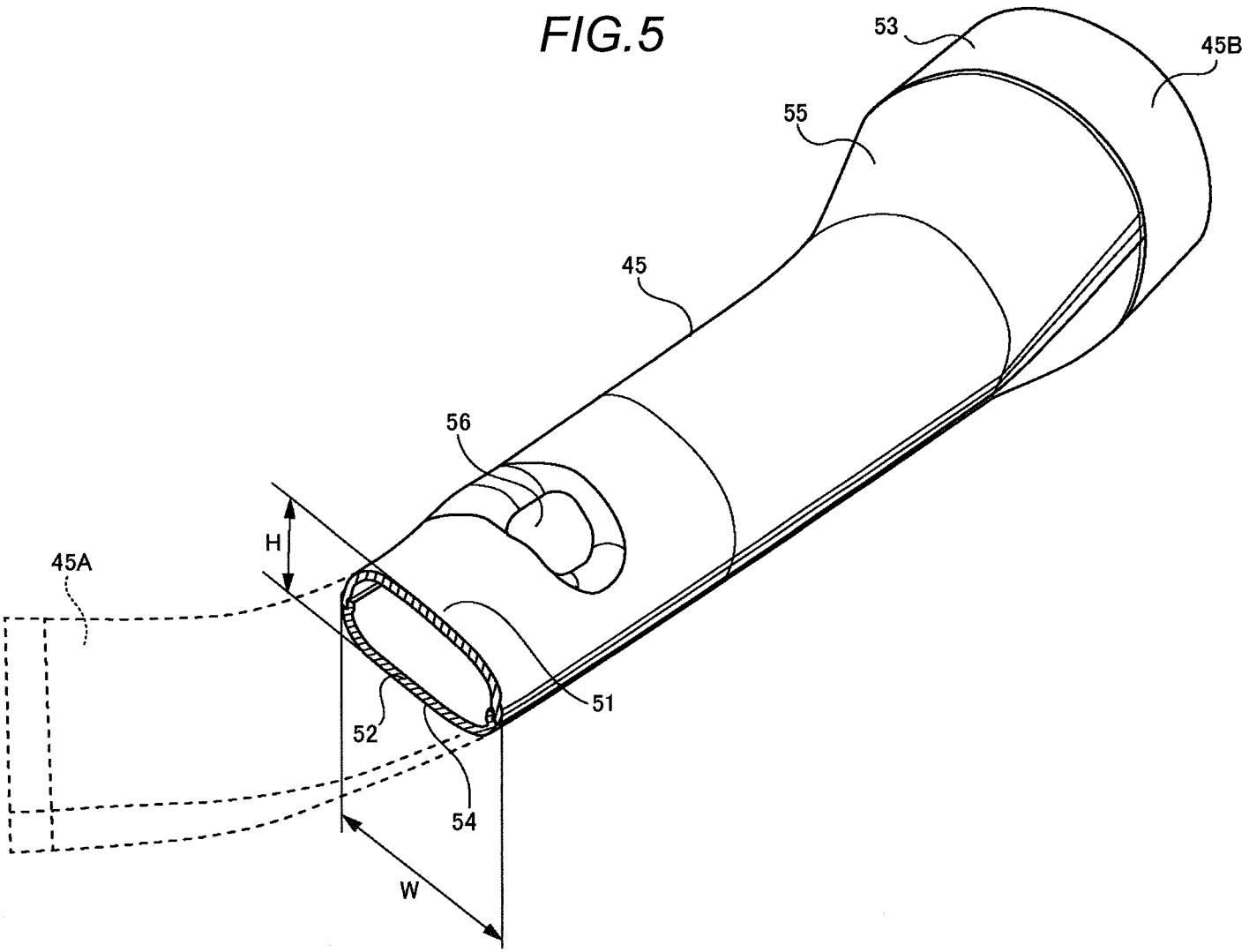
FIG. 5 illustrates a cross-sectional surface of the left connection pipe of the exhaust device of the illustrative embodiment of the present disclosure.
Figure 6:
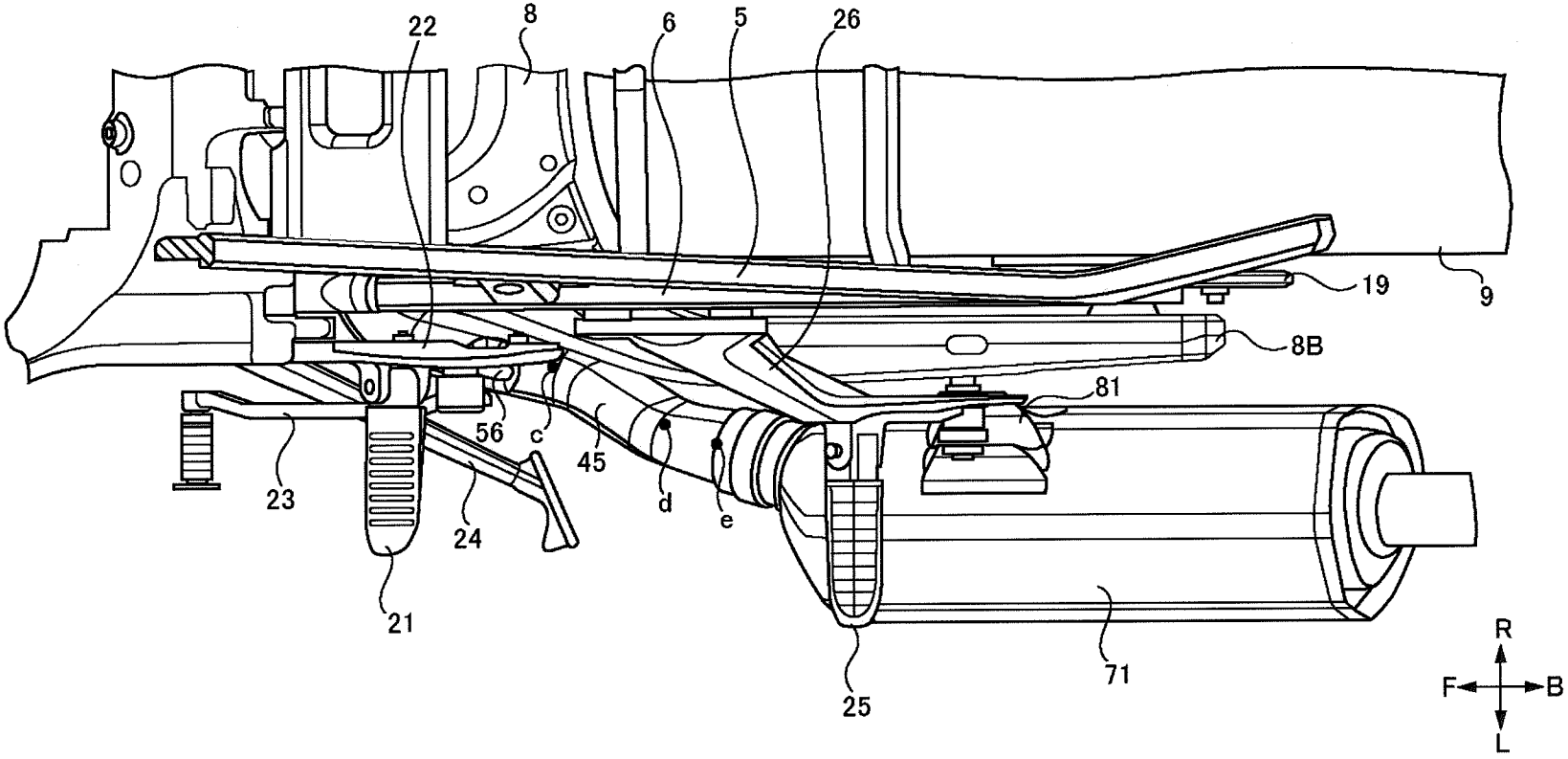
FIG. 6 depicts an outward appearance of the left connection pipe, the left muffler body and the like of the exhaust device of the illustrative embodiment of the present disclosure, as seen from above.
Figure 7:
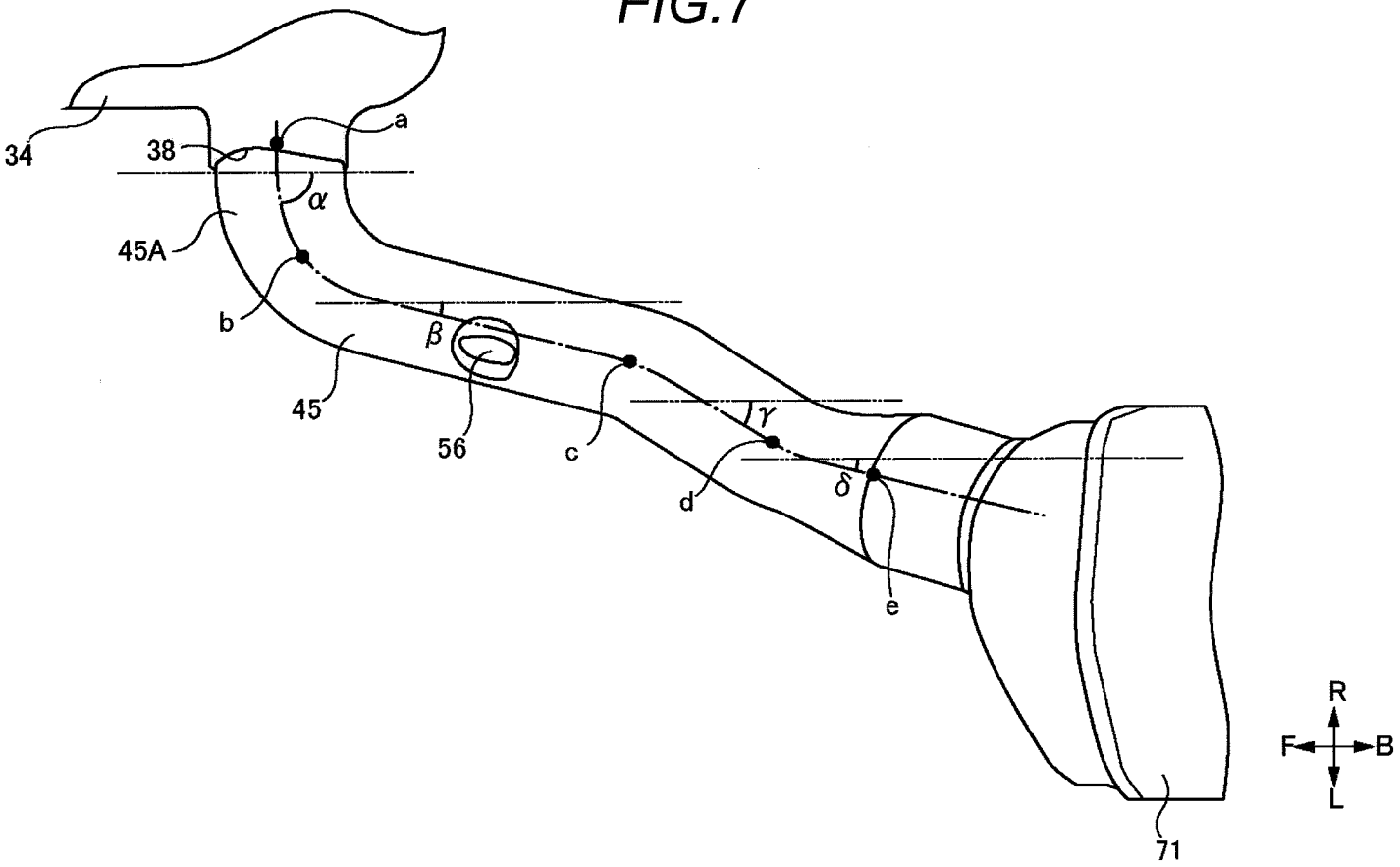
FIG. 7 illustrates the left connection pipe of the exhaust device of the illustrative embodiment of the present disclosure.
Figure 8:
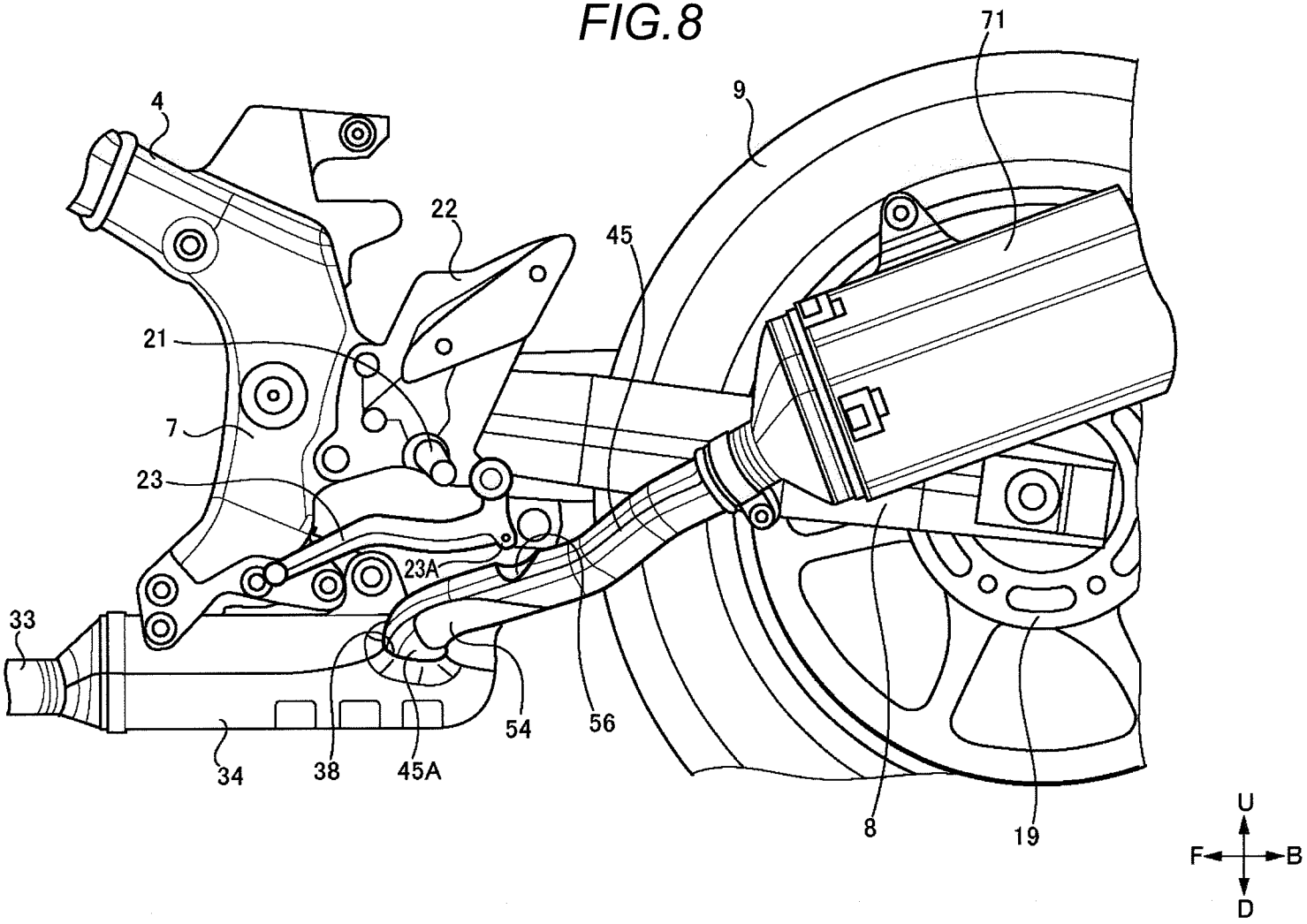
FIG. 8 depicts an outward appearance of the chamber, the left connection pipe, the left muffler body and the like of the exhaust device of the illustrative embodiment of the present disclosure, as seen from the left.

Here, the left connection pipe 45 is more specifically described with reference to FIGS. 5 to 8. FIG. 5 depicts the left connection pipe 45, in which the front end portion 45A is omitted. FIG. 6 depicts the left connection pipe 45, the left muffler body 71 and the like, as seen from above. FIG. 7 depicts the left connection pipe 45, as seen from above. FIG. 8 depicts the chamber 34, the left connection pipe 45, the left muffler body 71 and the like, as seen from the left. Meanwhile, in FIG. 8, the prop stand 24 is not shown for convenience of descriptions.

As shown in FIG. 5, the left connection pipe 45 is formed to have a pipe shape by two plate materials 51, 52 bonded to each other, except the rear end portion 45B. Specifically, the left connection pipe 45 has a first plate material 51 configured to form an upper part of a part of the left connection pipe 45 except the rear end portion 45B, a second plate material 52 configured to form a lower part of the part of the left connection pipe 45 except the rear end portion 45B, and a pipe member 53 configured to form the rear end portion 45B of the left connection pipe 45.

The first plate material 51 and the second plate material 52 are respectively formed by press working a metal plate. Also, the first plate material 51 has a cross-sectional surface shape that is convex upward, and the second plate material 52 has a cross-sectional surface shape that is convex downward. The pipe member 53 is a metallic short pipe. The left connection pipe 45 is formed by bonding edge portions of both left and right sides of the first plate material 51 and edge portions of both left and right sides of the second plate material 52 each other and bonding the pipe member 53 to rear end portions of the first plate material 51 and the second plate material 52 bonded to each other. Also, the first plate material 51, the second plate material 52 and the pipe member 53 are respectively bonded by welding.

Also, as shown in FIGS. 3 and 4, the left connection pipe 45 extends rearward with being inclined in a left upper direction from the left outlet 38 of the chamber 34 toward the muffler inlet 72 of the left muffler body 71, when the left connection pipe 45 is seen schematically. However, when seen closely, the left connection pipe 45 is not bilateral to the right connection pipe 41, in terms of shape and arrangement. Specifically, the left connection pipe 45 has more bent parts than the right connection pipe 41. Also, the left connection pipe 45 has a longer pipe length than the right connection pipe 41. That is, an exhaust passage formed by the left connection pipe 45 is longer than an exhaust passage formed by the right connection pipe 41.

Specifically, as shown in FIG. 7, the front end portion 45A of the left connection pipe 45 is connected to the left outlet 38 formed on the rear left surface of the chamber 34. A connection position a of the front end portion 45A of the left connection pipe 45 and the left outlet 38 of the chamber 34 is the same as a position of each footrest 21 in the front and back direction (refer to FIG. 2).

Then, as seen from above, the left connection pipe 45 extends leftward from the left outlet 38 to a position b (a position below a rear end of the shift lever 23), at which the shift lever 23 is arranged, with being substantially perpendicular to a straight-ahead direction of the straddle-type vehicle 1. An angle $\alpha$ of the extension direction of the left connection pipe 45 relative to the straight-ahead direction of the straddle-type vehicle 1 is about 90° between the position a and the position b. Meanwhile, in FIG. 7, a dashed-dotted line indicates an axis line of the left connection pipe 45, and a dashed-two dotted line indicates the straight-ahead direction of the straddle-type vehicle 1.

Then, as seen from above, the left connection pipe 45 is curved in a counterclockwise direction at the position b, and extends in a left back direction from the position b to a position c, which is the same as a rear end portion (tip end portion) of the prop stand 24 in the front and back direction (refer to FIG. 6). An angle $\beta$ of the extension direction of the left connection pipe 45 relative to the straight-ahead direction of the straddle-type vehicle 1 is smaller than the angle $\alpha$ between the position b and the position c.

Then, as seen from above, the left connection pipe 45 is curved in a clockwise direction at the position c, and extends in the left rear direction from the position c to a substantially intermediate position d between the rear end portion of the prop stand 24 and the muffler inlet 62 in the front and back direction (refer to FIG. 6). An angle $\gamma$ of the extension direction of the left connection pipe 45 relative to the straight-ahead direction of the straddle-type vehicle 1 is larger than the angle $\beta$ and is smaller than the angle $\alpha$ between the position c and the position d.

Then, as seen from above, the left connection pipe 45 is curved in the counterclockwise direction at the position d, and extends in the left back direction from the position d to a connection position e of the left connection pipe 45 and the muffler inlet 72 of the left muffler body 71. An angle $\delta$ of the extension direction of the left connection pipe 45 relative to the straight-ahead direction of the straddle-type vehicle 1 is smaller than the angle $\gamma$ between the position d and the position e.

As shown in FIG. 3, while the right connection pipe 41 has one bent part (a position g), the left connection pipe 45 has three bent parts (the positions b, c, d). That is, the left connection pipe 45 has the more bent parts than the right connection pipe 41. Also, the right connection pipe 41 is bent at the position g but has a small curvature and extends in a linear shape, as a whole. In contrast, the left connection pipe 45 is largely bent at the position b and is curved more than once after the position b, so that the left connection pipe 45 extends in a serpentine shape. That is, while the right connection pipe 41 extends from the right outlet 37 of the chamber 34 to the muffler inlet 62 of the right muffler body 61 over a short path, the left connection pipe 45 extends from the left outlet 38 of the chamber 34 to the muffler inlet 72 of the left muffler body 71 over a long path. Therefore, the left connection pipe 45 has a longer pipe length than the right connection pipe 41.

Also, as shown in FIG. 8, a flat surface part 54 of which an outer surface is flat over a wide range is formed at a lower side of the front part of the left connection pipe 45. Also, as shown in FIG. 5, the flat surface part 54 is formed on the second plate material 52 of the left connection pipe 45. Specifically, the flat surface part 54 is formed when press working the second plate material 52, in a stage before the second plate material 52 is bonded to the first plate material 51 and the pipe member 53. Also, the flat surface part 54 is formed in conformity to a maximum bank angle of the straddle-type vehicle 1. That is, as shown in FIG. 4, a position and an area of the flat surface part 54 of the left connection pipe 45 are formed so that a distance between the left connection pipe 45 and the ground becomes a predetermined distance when tilting the straddle-type vehicle 1 to a predetermined maximum bank angle upon the turning. In FIG. 4, the dashed-two dotted line indicates a predetermined distance and a spaced position from the ground when tilting the straddle-type vehicle 1 to the predetermined maximum bank angle. As can be seen from FIG. 4, an inclination angle of a surface of the flat surface part 54 substantially coincides with the maximum bank angle. Also, as seen from the front, an outer surface of a left lower part of the chamber 34, the surface of the flat surface part 54, and an outer surface of a lower part of a left front side of the left muffler 71 are arranged in a substantially linear shape, and an inclination angle of a straight line passing the corresponding surfaces substantially coincides with the maximum bank angle.

Also, as shown in FIG. 5, a cross-sectional surface shape of the front part of the left connection pipe 45 is a non-true circular shape. Specifically, the cross-sectional surface shape of the front part of the left connection pipe 45 is an elliptical shape or a rectangular shape having four chamfered corners of which a vertical length H is shorter than a length W in the right and left direction.

Also, as shown in FIG. 3, the length W in the right and left direction of the cross-sectional surface of the front part of the left connection pipe 45 is equal to or smaller than a diameter K of the right connection pipe 41, and the length H in the vertical direction of the cross-sectional surface of the front part of the left connection pipe 45 is less than the diameter K of the right connection pipe 41. For this reason, an area of the cross-sectional surface of the front part of the left connection pipe 45 is smaller than an area of the cross-sectional surface of the right connection pipe 41.

Also, as shown in FIG. 5, a rear part of the left connection pipe 45 is formed with a diameter-enlarged part 55 of which an area of a cross-sectional surface increases toward the rear. As a result, a part of the left connection pipe 45 located at the left muffler body-side has a larger area of the cross-sectional surface than a part located at the chamber-side. Also, as described above, the cross-sectional surface of the part of the left connection pipe 45 located in front of the diameter-enlarged part 55 has an elliptical or rectangular shape. However, the cross-sectional surface of a part of the left connection pipe 45 located at the rear of the diameter-enlarged part 55 has a true circular shape. That is, the shape of the cross-sectional surface of the diameter-enlarged part 55 changes from the elliptical or rectangular shape to the true circular shape from the front end portion toward the rear end portion.

Also, as shown in FIG. 5, an upper part of the front part of the left connection pipe 45 is formed with a concave part 56. The concave part 56 is formed at the first plate material 51 of the left connection pipe 45. Specifically, the concave part 56 is formed when press working the first plate material 51, in a stage before bonding the first plate material 51 to the second plate material 52 and the pipe member. Also, as shown in FIG. 8, the concave part 56 is arranged at a position facing a protrusion 23A protruding downward from the rear end portion of the shift lever 23.

(Muffler Body)

As shown in FIG. 2, the right muffler body 61 is arranged at the right side (the side at which the drive chain 20 is not arranged) of the straddle-type vehicle 1, in the region at the rear of the chamber 34. Also, the left muffler body 71 is arranged at the left side (the side at which the drive chain 20 is arranged) of the straddle-type vehicle 1, in the region at the rear of the chamber 34. As can be seen from FIGS. 1 and 2, the right muffler body 61 and the left muffler body 71 are respectively arranged at both the left and right sides of the rear wheel 9, and are all arranged at positions lower than an upper end portion of the rear wheel 9. Also, the right muffler body 61 and the left muffler body 71 are respectively supported to the lower seat rails 6 via support brackets 81 and the stays 26.

Also, as shown in FIG. 3, the front end portion of the right muffler body 61 is provided with the muffler inlet 62, and the rear end portion thereof is provided with a muffler outlet 63. Also, the muffler inlet 62 is connected with the rear end portion of the right connection pipe 41. Likewise, the front end portion of the left muffler body 71 is provided with the muffler inlet 72, and the rear end portion thereof is provided with a muffler outlet 73. Also, the muffler inlet 72 is connected with the rear end portion 45B of the left connection pipe 45.

Also, the right muffler body 61 and the left muffler body 71 are provided with the internal passages, respectively. Here, FIG. 9 depicts a right internal passage 64 provided in the right muffler body 61 and a left internal passage 74 provided in the left muffler body 71.

Figure 9:
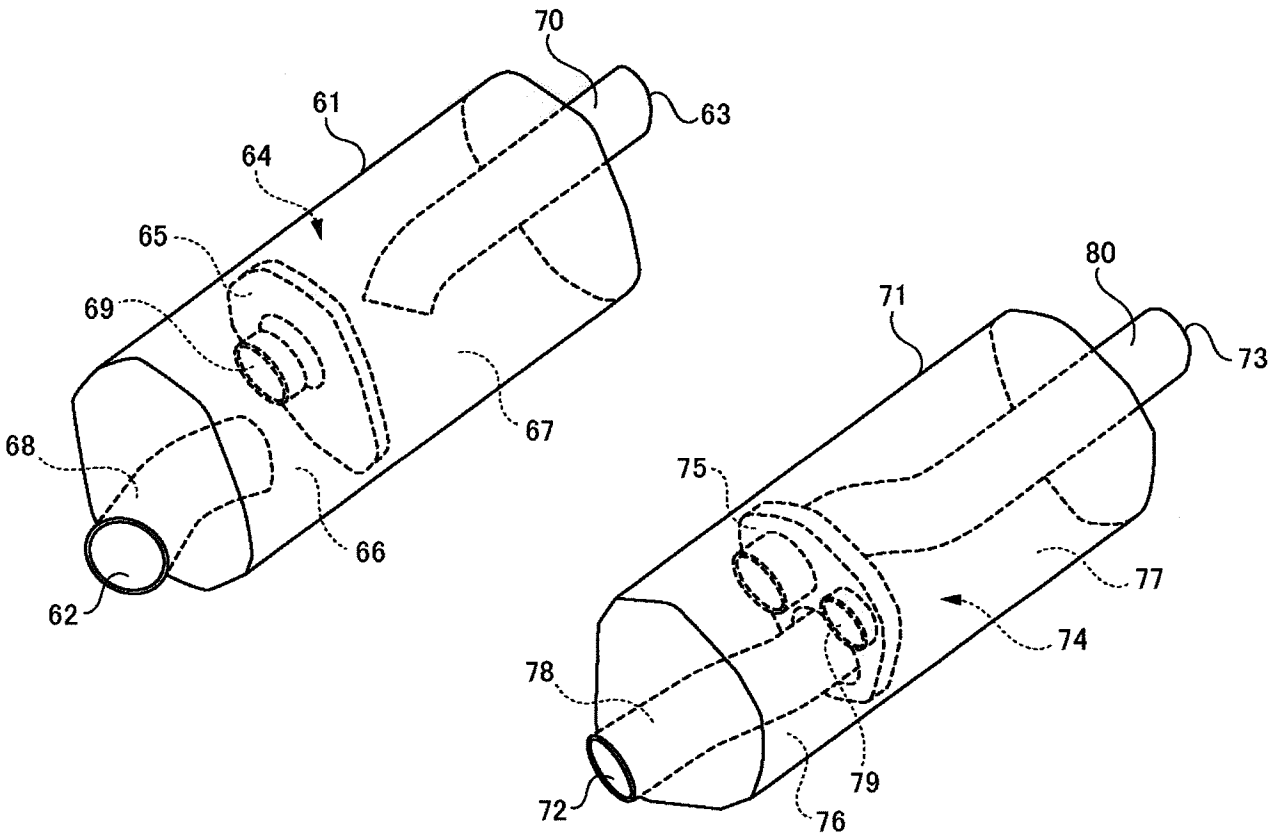
FIG. 9 illustrates an internal passage provided in each muffler body of the exhaust device of the illustrative embodiment of the present disclosure.

In FIG. 9, the right internal passage 64 has a structure of causing the exhaust air, which is introduced into the right muffler body 61 from the front of the right muffler body 61, to flow out to the rear of the right muffler body 61 without reversing the exhaust air. Specifically, an inside of the right muffler body 61 is divided in the front and back direction by a partition part 65, so that a front side in the right muffler body 61 is formed with a front chamber 66 and a rear side is formed with a rear chamber 67. Also, a front part of the right muffler body 61 is provided with an inlet piping 68 for enabling the muffler inlet 62 and the front chamber 66 to communicate with each other. Also, the partition part 65 is formed with a communication passage 69 for enabling the front chamber 66 and the rear chamber 67 to communicate with each other. Also, a rear part of the right muffler body 61 is provided with an outlet piping 70 for enabling the rear chamber 67 and an outside of the right muffler body 61 to communicate with each other, and a rear end opening of the outlet piping 70 is configured as the muffler outlet 63.

On the other hand, the left internal passage 74 has a structure of guiding the exhaust air, which is introduced into the left muffler body 71 from the front of the left muffler body 71, to the rear part of the left muffler body 71, reversing the exhaust air, guiding the same to the front part of the left muffler body 71, again reversing the exhaust air and then causing the same to flow out to the rear of the left muffler body 71. Specifically, an inside of the left muffler body 71 is divided in the front and back direction by a partition part 75, so that a front side in the left muffler body 71 is formed with a front chamber 76 and a rear side is formed with a rear chamber 77. Also, a front part of the left muffler body 71 is provided with an inlet piping 78 for enabling the muffler inlet 72 and the rear chamber 77 to communicate with each other. Also, the partition part 75 is formed with a communication passage 79 for enabling the rear chamber 77 and the front chamber 76 to communicate with each other. Also, a rear part of the left muffler body 71 is provided with an outlet piping 80 for enabling the front chamber 76 and an outside of the left muffler body 71 to communicate with each other, and a rear end opening of the outlet piping 80 is configured as the muffler outlet 73.

In a high load state of the engine 11, the exhaust control valve 42 is opened under control of the ECU. For example, as the load of the engine 11 increases, the degree of opening of the exhaust control valve 42 increases. When the degree of opening of the exhaust control valve 42 increases to some extent, the exhaust air having flowed out from each exhaust port 15 of the engine 11 circulates in each exhaust pipe 32 and each collecting pipe 33 and flows into the chamber 34. Then, most of the exhaust air circulates in the right connection pipe 41 and flows into the muffler inlet 62 of the right muffler body 61. The exhaust air having flowed into the muffler inlet 62 sequentially circulates in the inlet piping 68, the front chamber 66, the communication passage 69, the rear chamber 67 and the outlet piping 70 in the right muffler body 61, and then flows out from the muffler outlet 63 to the outside of the right muffler body 61. The right connection pipe 41 has a linear shape as a whole, is shorter than the left connection pipe 45 and has a larger passage area. Also, as described above, the right internal passage 64 provided in the right muffler body 61 does not have a structure of reversing the circulation direction of the exhaust air. Therefore, the exhaust air circulates in the right connection pipe 41 and the right internal passage 64, so that it is smoothly discharged to the atmosphere.

On the other hand, in a low load state of the engine 11, in order to improve engine torque, the degree of opening of the exhaust control valve 42 is decreased under control of the ECU, for example. In this case, the exhaust air having flowed out from each exhaust port 15 of the engine 11 circulates in each exhaust pipe 32 and each collecting pipe 33 and flows into the chamber 34. Thereafter, most of the exhaust air circulates in the left connection pipe 45 and flows into the muffler inlet 72 of the left muffler body 71. The exhaust air having flowed into the muffler inlet 72 flows into the rear chamber 77 via the inlet piping 78, is reversed in the rear chamber 77, and flows into the front chamber 76 via the communication passage 79, in the left muffler body 71. The exhaust air having flowed into the front chamber 76 is again reversed in the front chamber 76, circulates in the outlet piping 80 and is then discharged from the muffler outlet 73 to the atmosphere. The left connection pipe 45 has the plurality of bent parts, is longer than the right connection pipe 41 and has a smaller passage area. Also, the left internal passage 74 provided in the left muffler body 71 has the structure of reversing the circulation direction of the exhaust air, as described above. Therefore, while the exhaust air circulates in the left connection pipe 45 and the left internal passage 74, a resistance is presented to the flow of the exhaust air, so that a back pressure is increased.

As described above, according to the exhaust device 31 of the illustrative embodiment of the present disclosure, the part of the left connection pipe 45 except the rear end portion 45B is formed to have a pipe shape by the two plate materials 51, 52 bonded to each other. Each of the plate materials 51, 52 is a metal plate, and can be easily formed by the press working. Therefore, the left connection pipe 45 is formed by bonding the plate materials 51, 52, so that it is possible to increase a degree of freedom of a shape setting of the left connection pipe 45. For this reason, it is possible to easily form the left connection pipe 45 having the three bent parts. Also, in general, when a pipe is largely bent, a weak part is likely to be generated at the bent part, so that strength of the pipe may be lowered. In contrast, since the left connection pipe 45 is formed to have a pipe shape by bonding the respective plate materials 51, 52 after the plate materials are formed with the bent parts by the press working, a weak part is difficult to be generated at the bent part. Therefore, it is possible to form the left connection pipe 45, which has the bent part of which the curvature is large and the high strength. Accordingly, even when the left outlet 38 of the chamber 34 and the muffler inlet 72 of the left muffler body 71 are arranged closely to each other, it is possible to easily lengthen the exhaust passage between the chamber and left muffler body by interconnecting the chamber and left muffler body by the left connection pipe 45 having the plurality of bent parts and having the large curvature of the bent part (the bent part at the position b). Also, it is possible to easily lengthen the pipe length of the left connection pipe 45 than the pipe length of the right connection pipe 41, to easily make the more bent parts of the left connection pipe 45 than the bent parts of the right connection pipe 41, and to easily make the curvature of the bent part of the left connection pipe 45 greater than the curvature of the bent part of the right connection pipe 41. Thereby, in the low load state of the engine 11, when the degree of opening of the exhaust control valve 42 is decreased, the resistance is presented to the flow of the exhaust air in the left connection pipe 45, so that the back pressure can be increased. Accordingly, it is possible to suppress lowering of torque of the engine 11 during low revolution.

Also, since the left connection pipe 45 has the high degree of freedom of the shape setting, it is possible to easily arrange the left connection pipe 45 having a long pipe length in a narrow space. Therefore, even when the chamber 34 and the left muffler body 71 are arranged further closely to each other as a result of shortening of a wheelbase of the straddle-type vehicle 1, it is possible to interconnect the chamber 34 and the left muffler body 71 by the left connection pipe 45 having a long pipe length.

Also, since the left connection pipe 45 has the high degree of freedom of the shape setting, it is possible to easily and precisely determine positions of the plurality of bent parts to be formed at the left connection pipe 45. Therefore, it is possible to easily set a shape and a layout of the left connection pipe 45 so as to avoid contact between a plurality of components arranged around the left outlet 38 of the chamber 34 and the left connection pipe 45. In the illustrative embodiment, it is possible to easily set the shape and layout of the left connection pipe 45 so that the left connection pipe 45 is to pass a narrow space between the swing arm 8 and the shift lever 23 and prop stand 24. Accordingly, it is possible to prevent the left connection pipe 45 from contacting the swing arm 8, the shift lever 23 or the prop stand 24.

Also, the left connection pipe 45 has a non-true circular, specifically elliptical or rectangular cross-sectional surface shape. Thereby, it is possible to secure a sufficient interval between the left connection pipe 45 and the shift lever 23 (a part except the protrusion 23A) arranged above the left connection pipe 45, so that it is possible to prevent the left connection pipe 45 from contacting the shift lever 23.

Also, the left connection pipe 45 is formed with the concave part 56, and the concave part 56 is arranged at the position facing the protrusion 23A of the shift lever 23. Thereby, it is possible to secure a sufficient interval between the concave outer surface of the concave part 56 and the protrusion 23A of the shift lever 23, so that it is possible to prevent the left connection pipe 45 from contacting the protrusion 23A of the shift lever 23.

Also, the left connection pipe 45 is formed with the flat surface part 54, so that it is possible to increase the distance between the left connection pipe 45 and the ground during the turning of the straddle-type vehicle 1. Thereby, it is possible to increase the maximum bank angle of the straddle-type vehicle 1.

Also, the left connection pipe 45 has the smaller area of the cross-sectional surface than the right connection pipe 41. Thereby, it is possible to make the resistance, which is to be presented to the exhaust air flowing in the left connection pipe 45, greater than the resistance, which is to be presented to the exhaust air flowing in the right connection pipe 41. Therefore, it is possible to increase the back pressure when decreasing the degree of opening of the exhaust control valve 42 in the low load state, thereby suppressing the lowering of the torque during the low revolution. Also, it is possible to make the left connection pipe 45 thin. Therefore, even when intervals of the plurality of components arranged around the left outlet 38 of the chamber 34 are narrow, it is possible to enable the left connection pipe 45 to pass between the components.

Also, the left connection pipe 45 has the diameter-enlarged part 55, so that the area of the cross-sectional surface of the part located at the left muffler body-side is larger than the part located at the chamber-side. In the straddle-type vehicle 1, more components (the shift lever 23, the prop stand 24, and the like) are arranged at the chamber-side, as compared to the muffler body-side. The area of the cross-sectional surface of the part of the left connection pipe 45 located at the chamber-side is reduced, so that it is possible to easily prevent the left connection pipe 45 from contacting the components provided at the chamber-side. Also, the diameter of the part of the left connection pipe 45 located at the left muffler body-side is enlarged, so that it is possible to adjust the resistance, which is to be presented to the exhaust air circulating in the left connection pipe 45, so as to improve the exhaust sound.

Also, according to the exhaust device 31 of the illustrative embodiment of the present disclosure, the right connection pipe 41 is connected to the rear surface of the chamber 34, and the left connection pipe 45 is connected to the left surface of the chamber 34. Thereby, the right connection pipe 41 can be made to extend in a substantially linear shape as a whole from the rear surface of the chamber 34 toward the right muffler body 61, and the right connection pipe 41 can be shortened. Therefore, when the exhaust control valve 42 is largely opened in the high load state of the engine 11, the exhaust air can be smoothly discharged to the atmosphere. On the other hand, the left connection pipe 45 can be easily extended so as to avoid the contact with the drive chain 20, the shift lever 23 and the like from the left surface of the chamber 34 toward the left muffler body 71. Also, the left connection pipe 45 can be lengthened, so that it is possible to increase the back pressure in the low load state.

Also, according to the exhaust device 31 of the illustrative embodiment of the present disclosure, the rear end of the chamber 34 is located at the rear of the footrest 21. The chamber 34 is made to extend rearward in this way, so that it is possible to enlarge a volume of the chamber 34 and to thus increase the effect of reducing the exhaust sound by the chamber 34.

Also, the connection position of the left connection pipe 45 and the chamber 34 is the same as the position of the footrest 21 in the front and back direction. In this way, the connection position of the left connection pipe 45 and the chamber 34 is set to the front of the rear end of the chamber 34, so that it is possible to increase a distance between the left outlet 38 of the chamber 34 and the left muffler body 71. Accordingly, it is possible to increase the degree of layout freedom when arranging the left connection pipe 45 longer than the right connection pipe 41 between the left outlet 38 of the chamber 34 and the left muffler body 71.

Also, as seen from above, the left connection pipe 45 extends to the shift lever 23 in the right and left direction, is curved and then extends rearward. In this way, since the left connection pipe 45 extends laterally and is then bent rearward, it is possible to increase the pipe length of the left connection pipe 45.

Also, according to the exhaust device 31 of the illustrative embodiment of the present disclosure, the right muffler body 61 includes the right internal passage 64, which does not have the structure of reversing the circulation direction of the exhaust air, and the left muffler body 71 includes the left internal passage 74, which has the structure of reversing the circulation direction of the exhaust air. By this configuration, in the high load state of the engine 11, the degree of opening of the exhaust control valve 42 is increased to cause the exhaust air to mainly circulate in the right internal passage 64 of the right muffler body 61, so that it is possible to smoothly discharge the exhaust air to the atmosphere. Thereby, it is possible to increase an output of the engine 11, and to create a fascinating exhaust sound, which expresses that the engine 11 is favorably racing. Also, in the low load state of the engine 11, the degree of opening of the exhaust control valve 42 is decreased to cause most of the exhaust air to circulate in the left internal passage 74 of the left muffler body 71, so that it is possible to increase the back pressure. Thereby, it is possible to suppress the lowering of the torque of the engine 11 during the low revolution.

In the illustrative embodiment, the part of the left connection pipe 45 except the rear end portion 45B is formed by bonding the two plate materials 51, 52. However, the part of the left connection pipe 45, which is to be formed by bonding the two plate materials 51, 52, is not limited thereto. For example, the left connection pipe 45 may be entirely formed by bonding the two plate materials 51, 52 or only an intermediate part of the left connection pipe 45 may be formed by bonding the two plate materials 51, 52. Also, in the illustrative embodiment, the front part of the left connection pipe 45 is formed to have a non-true circular cross-sectional surface shape. However, the part of the left connection pipe 45, which is to be formed to have a non-true circular cross-sectional surface shape, is not limited thereto. Also, the positions and numbers of the flat surface part 54 and concave part of the left connection pipe 45 are not limited to the illustrative embodiment.

Also, in the illustrative embodiment, the three bent parts are formed at the left connection pipe 45. However, the number of the bent parts to be formed at the left connection pipe 45 may be two or four or more. Also, the left connection pipe 45 may be formed with a bent part largely bent upward or downward.

Also, in the illustrative embodiment, the exhaust control valve 42 is mounted to the right connection pipe 41. However, the present disclosure is not limited thereto. For example, the exhaust control valve 42 may be provided in the right outlet 37 of the chamber 34 or in the right muffler body 61.

Also, regarding the straddle-type vehicle to which the present disclosure is applied, the numbers of the cylinders of the engine, the exhaust ports and the exhaust pipes are not limited to four. Also, in case of a straddle-type vehicle in which the arrangement of the components is reverse to the straddle-type vehicle 1 of the illustrative embodiment in the right and left direction, for example, the chain drive is arranged at the right side, the arrangement of the muffler body and the connection pipe of the exhaust device of the present disclosure may be reverse to the arrangement of the muffler body and the connection pipe of the exhaust device 31 of the illustrative embodiment in the right and left direction. Also, the straddle-type vehicle to which the present disclosure is applied is not limited to a motorcycle, and may be a three-wheeled vehicle, a buggy car and the like.

Also, in the illustrative embodiment, the exhaust pipe 32 and the collecting pipe 33 are specific examples of "the exhaust pipe" defined in the claims. Also, the right muffler body 61 is a specific example of "the first muffler body" defined in the claims, and the left muffler body 71 is a specific example of "the second muffler body" defined in the claims. Also, the right connection pipe 41 is a specific example of "the first connection pipe" defined in the claims, and the left connection pipe 45 is a specific example of "the second connection pipe" defined in the claims. Also, the right internal passage 64 is a specific example of "the first internal passage" defined in the claims, and the left internal passage 74 is a specific example of "the second internal passage" defined in the claims.

Also, the present disclosure can be appropriately changed without departing from the gist or spirit of the invention that can be understood from the claims and the specification, and an exhaust device of a straddle-type vehicle including the changes is also included in the technical spirit of the present disclosure.

What is claimed is:

1. An exhaust device of a straddle-type vehicle, comprising:

a chamber arranged at the rear of an engine of the straddle-type vehicle;

an exhaust pipe configured to interconnect an exhaust port of the engine and the chamber;

a first muffler body arranged at one side, at which a drive chain is not arranged, of a left side and a right side of the straddle-type vehicle, in a region at the rear of the chamber;

a second muffler body arranged at another side, at which the drive chain is arranged, of the left side and the right side of the straddle-type vehicle, in the region at the rear of the chamber;

a first connection pipe configured to interconnect the chamber and the first muffler body;

a second connection pipe configured to interconnect the chamber and the second muffler body; and an exhaust control valve configured to control a flow rate of exhaust air to circulate from the exhaust port toward the first muffler body via the exhaust pipe, the chamber and the first connection pipe, wherein a part or all of the second connection pipe is formed to have a pipe shape by two or more plate materials bonded to each other, and has a non-true circular cross-sectional surface shape, wherein the second connection pipe has an area of a cross-sectional surface smaller than the first connection pipe.

2. The exhaust device of a straddle-type vehicle according to claim 1, wherein the second connection pipe has a pipe length longer than the first connection pipe.

3. The exhaust device of a straddle-type vehicle according to claim 1, wherein the second connection pipe has more bent parts than the first connection pipe.

4. The exhaust device of a straddle-type vehicle according to claim 1, wherein the second connection pipe is formed with a concave part, and the concave part is arranged at a position facing a shift lever of the straddle-type vehicle.

5. The exhaust device of a straddle-type vehicle according to claim 1, wherein a part of the second connection pipe located at the chamber-side has an area of a cross-sectional surface smaller than an area of a cross-sectional surface of a part located at the second muffler body-side.

6. The exhaust device of a straddle-type vehicle according to claim 1, wherein the first connection pipe is connected to a rear surface of the chamber, and the second connection pipe is connected to a side surface of the chamber.

7. The exhaust device of a straddle-type vehicle according to claim 1, wherein a rear end of the chamber is located at the rear of a footrest, wherein a connection position of the second connection pipe and the chamber is the same as a position of the footrest in a front and back direction, and wherein as seen from above, the second connection pipe extends to a shift lever in a right and left direction, is curved, and then extends rearward.

8. The exhaust device of a straddle-type vehicle according to claim 1, wherein the first muffler body comprises a first internal passage configured to cause the exhaust air, which is introduced into the first muffler body from the front of the first muffler body, to flow out to the rear of the first muffler body without reversing the exhaust air, and wherein the second muffler body comprises a second internal passage configured to guide the exhaust air, which is introduced into the second muffler body from the front of the second muffler body, to a rear part of the second muffler body, to reverse the same, to guide the exhaust air to a front part of the second muffler body, again to reverse the same, and to cause the exhaust air to flow out to the rear of the second muffler body.

* * * * *